US010005272B2

(12) United States Patent
Noguchi et al.

(10) Patent No.: US 10,005,272 B2
(45) Date of Patent: Jun. 26, 2018

(54) INTERMEDIATE TRANSFER BODY, IMAGE RECORDING METHOD, AND IMAGE FORMING APPARATUS

(71) Applicant: CANON KABUSHIKI KAISHA, Tokyo (JP)

(72) Inventors: Mitsutoshi Noguchi, Kawaguchi (JP); Takuto Moriguchi, Kamakura (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/628,860

(22) Filed: Jun. 21, 2017

(65) Prior Publication Data

US 2017/0368818 A1 Dec. 28, 2017

(30) Foreign Application Priority Data

Jun. 24, 2016 (JP) ..... 2016-125681

(51) Int. Cl.

| | |
|---|---|
| ***B41J 2/005*** | (2006.01) |
| ***B41J 2/01*** | (2006.01) |
| ***B41J 11/04*** | (2006.01) |
| ***B41J 11/057*** | (2006.01) |

(52) U.S. Cl.

CPC ..... *B41J 2/0057* (2013.01); *B41J 2/01* (2013.01); *B41J 11/04* (2013.01); *B41J 11/057* (2013.01); *B41J 2002/012* (2013.01)

(58) Field of Classification Search

CPC ... B41J 2/01; B41J 2/0057; B41J 11/04; B41J 11/057

See application file for complete search history.

(56) References Cited

U.S. PATENT DOCUMENTS

| | | | | |
|---|---|---|---|---|
| 6,937,827 | B2 * | 8/2005 | Katoh | G03G 15/657 399/43 |
| 8,871,337 | B2 | 10/2014 | Kushida et al. | |
| 9,102,137 | B2 * | 8/2015 | Koitabashi | B41J 2/0057 |
| 9,348,269 | B1 | 5/2016 | Bridges et al. | |
| 9,527,314 | B2 | 12/2016 | Moriguchi et al. | |

FOREIGN PATENT DOCUMENTS

| | | | |
|---|---|---|---|
| JP | 62-124993 | A | 6/1987 |
| JP | 7-32721 | A | 2/1995 |
| JP | 2002-370442 | A | 12/2002 |
| WO | 2012/014427 | A1 | 2/2012 |
| WO | 2013/132438 | A2 | 9/2013 |

OTHER PUBLICATIONS

Extended European Search Report in European Application No. 17177563.8 (dated Nov. 9, 2017).

* cited by examiner

*Primary Examiner* — Lamson Nguyen

(74) *Attorney, Agent, or Firm* — Fitzpatrick, Cella, Harper & Scinto

(57) ABSTRACT

An intermediate transfer body includes a surface layer, an elastic layer, and a heat-insulating layer contiguously in the mentioned order, and the surface layer, the elastic layer, and the heat-insulating layer satisfy the following Equations 1 to 4:

$(C1+C2)\times\Delta t\leq Q$ Equation 1:

$100\ \text{MPa}\leq E1\leq 1{,}000\ \text{MPa}$ Equation 2:

$0.5\ \text{MPa}\leq E2\leq 50\ \text{MPa}$ Equation 3:

$\lambda 3\leq 0.13\ \text{W/m}\cdot\text{K}\leq\lambda 1\leq\lambda 2.$ Equation 4:

21 Claims, 1 Drawing Sheet

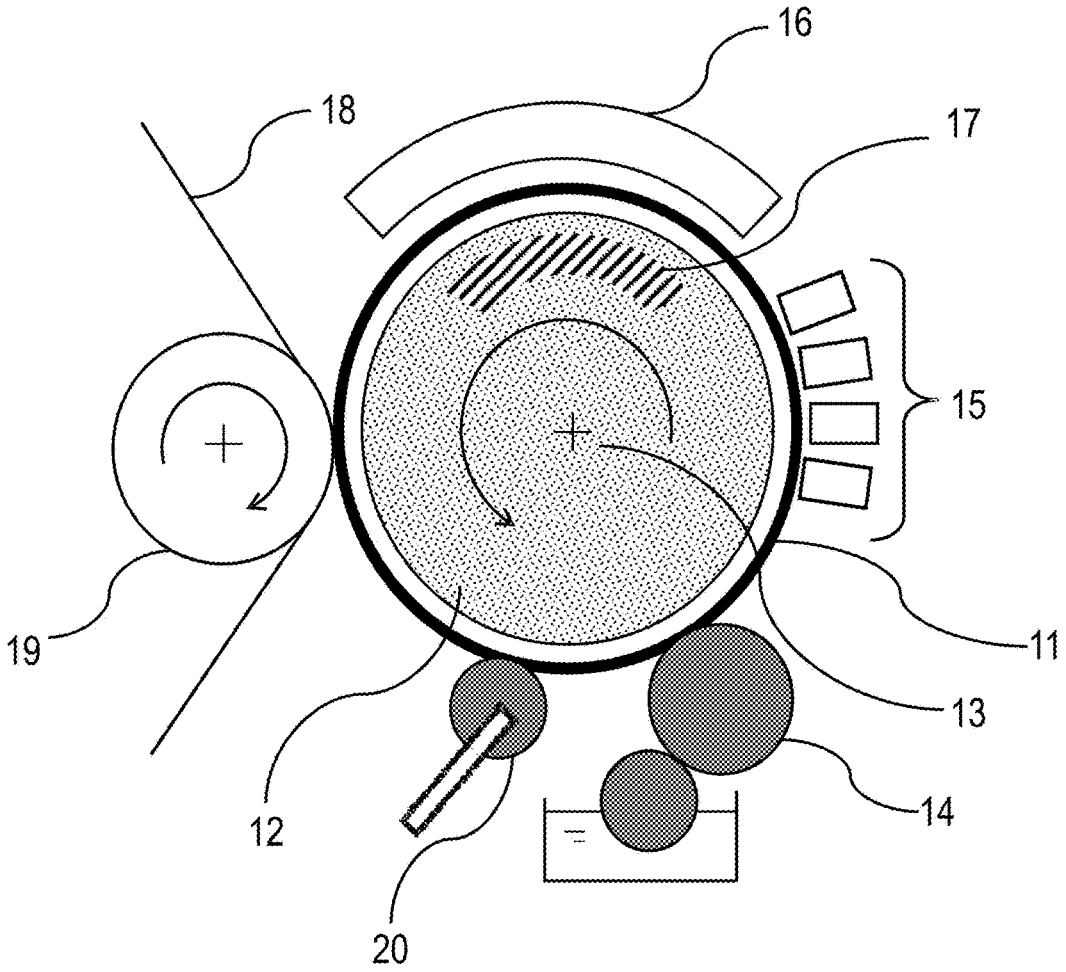
16
18
17
15
19
11
13
12
14
20

INTERMEDIATE TRANSFER BODY, IMAGE RECORDING METHOD, AND IMAGE FORMING APPARATUS

BACKGROUND OF THE INVENTION

Field of the Invention

The present invention relates to an intermediate transfer body and to an image forming method and an image forming apparatus using the intermediate transfer body.

Description of the Related Art

As information has diversified, a wider variety of printed matters have been produced in smaller lot sizes. In such a trend, printing using plates becomes expensive to make a plate for each printed matter, and the unit price of products printed by the conventional printing system including offset printing may be comparatively expensive. In addition, rapid information transfer by printed matters has been emphasized, and this trend causes another problem. In other words, the conventional printing system takes a long lead time from plate making to printing preparation, and has a limitation in reduction of the time until the distribution of printed matters even when the number of printed matters is small.

To address such market demands as above, an ink jet printing system is drawing attention as a preferred technique. In other words, the ink jet printing system uses no plates, and thus the plate making cost is comparatively inexpensive even in a small lot production. In addition, no lead time is needed, and an intended printed matter can be instantly produced. For the above reasons, the ink jet printing system should be a printing system suitable for a wide variety of printed matters in small lot sizes.

The image forming method on the transfer system using an intermediate transfer body has high applicability to a wide variety of recording media, is also suited for the production of a wide variety of printed matters in small lot sizes, and is also preferably applicable to image forming methods on an ink jet printing system.

The image forming method on the transfer system typically includes the following steps.

(1) Intermediate Image Forming Step:

An ink jet device is used to apply an ink containing a coloring material component onto an intermediate transfer body, thereby forming an intermediate image.

(2) Transfer Step:

The intermediate transfer body on which the intermediate image is formed is brought into contact with a recording medium, thereby transferring the intermediate image onto the recording medium.

In the image forming method on the transfer system, it is important to achieve good transferability of the image formed on an intermediate transfer body to a recording medium.

Japanese Patent Application Laid-Open No. H07-32721 discloses a method for improving the transferability of an intermediate image from an intermediate transfer body to a recording medium. In the method, a resin emulsion having a minimum film-forming temperature (MFT) of 50° C. or more is added to an ink, and an intermediate transfer body is heated at a temperature not less than the minimum film-forming temperature of the resin emulsion for transfer.

Japanese Patent Application Laid-Open No. H07-32721 discloses an intermediate transfer body including a metal blank tube that is covered with an elastic layer made from a silicone rubber.

Japanese Patent Application Laid-Open No. S62-124993 discloses an intermediate transfer body including a reinforcement layer made from, for example, a woven fabric or a resin film between an elastic layer and a compressible layer.

SUMMARY OF THE INVENTION

The present invention is directed to providing an intermediate transfer body that maintains the image quality of an intermediate image and has good transferability and to provide an image forming method and an image forming apparatus using the intermediate transfer body.

An aspect of the present invention provides an image forming method including:

a step of applying an ink to an image forming surface of an intermediate transfer body to form an intermediate image of a temperature t1;

a step of performing temperature control such that the temperature of the intermediate image changes from the temperate t1 to a temperature t2; and a step of transferring the intermediate image of the temperature t2 to a recording medium, the intermediate transfer body including a surface layer having the image forming surface, an elastic layer, and a heat-insulating layer contiguously in the mentioned order, the surface layer, the elastic layer, and the heat-insulating layer satisfying the following Equations 1 to 4:

$$(C1+C2)\times\Delta t<Q \qquad \text{Equation 1:}$$

(in Equation 1, C1 is a heat capacity per 1 $m^2$ of the surface layer; C2 is a heat capacity per 1 $m^2$ of the elastic layer; $\Delta t=t2-t1$ and $\Delta t>0°$ C. are satisfied; Q is a heat quantity applied to 1 $m^2$ of a surface of the surface layer by heating at the temperature t1; and $Q\leq 50{,}000$ J)

$$100\ \text{MPa}\leq E1\leq 1{,}000\ \text{MPa} \qquad \text{Equation 2:}$$

(in Equation 2, E1 is a compressive elastic modulus of the surface layer)

$$0.5\ \text{MPa}\leq E2\leq 50\ \text{MPa} \qquad \text{Equation 3:}$$

(in Equation 3, E2 is a compressive elastic modulus of the elastic layer)

$$\lambda 3\leq 0.13\ \text{W/m}\cdot\text{K}\leq\lambda 1\leq\lambda 2 \qquad \text{Equation 4:}$$

(in Equation 4, λ1 is a thermal conductivity of the surface layer; λ2 is a thermal conductivity of the elastic layer; and λ3 is a thermal conductivity of the heat-insulating layer).

Another aspect of the present invention provides an intermediate transfer body used for an image forming method, the image forming method including a step of applying an ink to an image forming surface of an intermediate transfer body to form an intermediate image of a temperature t1; a step of performing temperature control such that the temperature of the intermediate image changes from the temperate t1 to a temperature t2; and a step of transferring the intermediate image of the temperature t2 to a recording medium, the intermediate transfer body satisfying the following Equations 1 to 4:

$$(C1+C2)\times\Delta t\leq Q \qquad \text{Equation 1:}$$

(in Equation 1, C1 is a heat capacity per 1 $m^2$ of the surface layer; C2 is a heat capacity per 1 $m^2$ of the elastic layer;

$\Delta t = t2 - t1$ and $\Delta t > 0°$ C. are satisfied; Q is a heat quantity applied to 1 $m^2$ of a surface of the surface layer by heating at the temperature t1; and $Q \leq 50{,}000$ J)

$$100\ \text{MPa} \leq E1 \leq 1{,}000\ \text{MPa} \qquad \text{Equation 2:}$$

(in Equation 2, E1 is a compressive elastic modulus of the surface layer)

$$0.5\ \text{MPa} \leq E2 \leq 50\ \text{MPa} \qquad \text{Equation 3:}$$

(in Equation 3, E2 is a compressive elastic modulus of the elastic layer)

$$\lambda 3 \leq 0.13\ \text{W/m·K} \leq \lambda 1 \leq \lambda 2 \qquad \text{Equation 4:}$$

(in Equation 4, λ1 is a thermal conductivity of the surface layer; λ2 is a thermal conductivity of the elastic layer; and λ3 is a thermal conductivity of the heat-insulating layer).

Still another aspect of the present invention provides an image forming apparatus including:

an intermediate transfer body;

an image forming unit configured to apply an ink to an image forming surface of the intermediate transfer body to form an intermediate image of a temperature t1, a temperature controlling unit configured to control the temperature of the intermediate image from the temperature t1 to a temperature t2, and a transfer unit configured to transfer the intermediate image of the temperature t2 from the intermediate transfer body to a recording medium, the intermediate transfer body including a surface layer having the image forming surface, an elastic layer, and a heat-insulating layer contiguously in the mentioned order, the surface layer, the elastic layer, and the heat-insulating layer satisfying the following Equations 1 to 4:

$$(C1 + C2) \times \Delta t \leq Q \qquad \text{Equation 1:}$$

(in Equation 1, C1 is a heat capacity per 1 $m^2$ of the surface layer; C2 is a heat capacity per 1 $m^2$ of the elastic layer; $\Delta t = t2 - t1$ and $\Delta t > 0°$ C. are satisfied; Q is a heat quantity applied to 1 $m^2$ of a surface of the surface layer by heating at the temperature t1; and $Q \leq 50{,}000$ J)

$$100\ \text{MPa} \leq E1 \leq 1{,}000\ \text{MPa} \qquad \text{Equation 2:}$$

(in Equation 2, E1 is a compressive elastic modulus of the surface layer)

$$0.5\ \text{MPa} \leq E2 \leq 50\ \text{MPa} \qquad \text{Equation 3:}$$

(in Equation 3, E2 is a compressive elastic modulus of the elastic layer)

$$\lambda 3 \leq 0.13\ \text{W/m·K} \leq \lambda 1 \leq \lambda 2 \qquad \text{Equation 4:}$$

(in Equation 4, λ1 is a thermal conductivity of the surface layer; λ2 is a thermal conductivity of the elastic layer; and λ3 is a thermal conductivity of the heat-insulating layer).

In the image forming apparatus, the intermediate transfer body includes a surface layer having the image forming surface, an elastic layer, and a heat-insulating layer contiguously in the mentioned order, and the surface layer, the elastic layer, and the heat-insulating layer satisfy Equations 1 to 4 mentioned above.

Further features of the present invention will become apparent from the following description of exemplary embodiments with reference to the attached drawing.

BRIEF DESCRIPTION OF THE DRAWING

The FIGURE is a schematic view showing an embodiment of an image forming apparatus according to the present invention.

DESCRIPTION OF THE EMBODIMENTS

Preferred embodiments of the present invention will now be described in detail in accordance with the accompanying drawing.

As described in Japanese Patent Application Laid-Open No. H07-32721, when an intermediate image formed by using an ink containing a resin emulsion having an MFT is transferred to a recording medium at a temperature not less than the MFT, the transferability of an image can be improved to reduce the pressure for the transfer. However, when an intermediate image is transferred to a recording medium at a high temperature not less than the MFT, the temperature in the image forming apparatus increases, and this may cause nozzles of an ink jet recording head to clog due to film formation of the resin emulsion. To address this problem, Japanese Patent Application Laid-Open No. H07-32721 specifies the MFT of a resin emulsion at a sufficiently higher temperature than the environmental temperature of a used recording head, thereby preventing nozzles of a recording head from clogging due to film formation of the resin emulsion.

In such an image forming method on the transfer system as described in Japanese Patent Application Laid-Open No. H07-32721, it is important to add a resin emulsion having a particularly controlled MFT to an ink. In order to deal with the production of a wide variety of printed matters in small lot sizes, however, inks having various formulations are preferably available.

The structure of the intermediate transfer body according to Japanese Patent Application Laid-Open No. S62-124993 may fail to satisfy the compressive elastic modulus required when the image quality is intended to be further improved.

An intermediate transfer body according to the present invention is used for an image forming method on the transfer system, and includes a heat-insulating layer, an elastic layer, and a surface layer that are successively and contiguously provided. The surface layer has an image forming surface on which an intermediate image is to be formed.

An image forming method on a transfer system using the intermediate transfer body according to the present invention includes a step of applying an ink to an image forming surface of an intermediate transfer body to thereby form an intermediate image of a temperature t1 (hereinafter called intermediate image forming temperature), a step of performing temperature control such that the temperature of the intermediate image changes from the temperate t1 to a temperature t2 (hereinafter called transferring temperature), and a step of transferring the intermediate image of the temperature t2 to a recording medium. Temperature control is performed in such a way that the intermediate image forming temperature t1 and the transferring temperature t2 satisfy the relation $\Delta t = t2 - t1$ (where $0°\ C. < \Delta t$).

The layers of the intermediate transfer body according to the present invention satisfy the following Equation 1 to Equation 4.

$$(C1 + C2) \times \Delta t \leq Q \qquad \text{Equation 1:}$$

(in Equation 1, C1 is a heat capacity per 1 $m^2$ of the surface layer; C2 is a heat capacity per 1 $m^2$ of the elastic layer; $\Delta t = t2 - t1$ and $\Delta t > 0°$ C. are satisfied; Q is a heat quantity applied to 1 $m^2$ of a surface of the surface layer by heating at the temperature t1; and $Q \leq 50{,}000$ J)

$$100\ \text{MPa} \leq E1 \leq 1{,}000\ \text{MPa} \qquad \text{Equation 2:}$$

(in Equation 2, E1 is a compressive elastic modulus of the surface layer)

$$0.5\ \text{MPa} \leq E2 \leq 50\ \text{MPa} \quad \text{Equation 3:}$$

(in Equation 3, E2 is a compressive elastic modulus of the elastic layer)

$$\lambda 3 \leq 0.13\ \text{W/m·K} \leq \lambda 1 \leq \lambda 2 \quad \text{Equation 4:}$$

(in Equation 4, λ1 is a thermal conductivity of the surface layer; λ2 is a thermal conductivity of the elastic layer; and λ3 is a thermal conductivity of the heat-insulating layer).

An image forming apparatus according to the present invention includes an intermediate transfer body having the above structure, an image forming unit configured to form an intermediate image of a temperature t1 on an image forming surface of the intermediate transfer body by applying an ink, a temperature controlling unit configured to control the temperature of the intermediate image from the temperature t1 to a temperature t2, and a transfer unit configured to transfer the intermediate image from the intermediate transfer body to a recording medium.

The intermediate image forming temperature t1 (° C.) is a temperature when an ink is applied onto an intermediate transfer body to form an intermediate image. In other words, the intermediate image forming temperature t1 is the temperature of an intermediate image when an ink is applied onto an intermediate transfer body to form the intermediate image. The ink applied onto an intermediate transfer body instantly has substantially the same temperature as the temperature of the intermediate transfer body, and thus the intermediate image forming temperature t1 can also be considered to be the surface temperature of an intermediate transfer body when an ink is applied onto the intermediate transfer body to form an intermediate image.

The transferring temperature t2 (° C.) is a temperature when an intermediate image formed on an intermediate transfer body is brought into contact with and transferred to a recording medium. In other words, the transferring temperature t2 is the temperature of an intermediate image when the intermediate image formed on an intermediate transfer body is brought into contact with and transferred to a recording medium. When transferred, an intermediate image is held on an intermediate transfer body. Thus, the transferring temperature t2 can also be considered to be the surface temperature of an intermediate transfer body when the intermediate image formed on the intermediate transfer body is brought into contact with and transferred to a recording medium.

The temperature control of Δt can be performed by adjusting one or both of t1 and t2. The temperature control of Δt can be performed by any means. For example, a temperature controlling unit can be used to heat the surface layer of an intermediate transfer body, thereby adjusting the temperature. As the heater used for the temperature control of Δt, a typical heater for industrial use, including a heater generating heat and a heater performing infrared irradiation, can be used. As needed, a cooler can be used in combination to perform the temperature control.

When satisfying the above structure, the intermediate transfer body, the image forming method, and the image forming apparatus according to the present invention are versatile in various formulations of inks, maintain the image quality of intermediate images, and achieve higher transferability.

The intermediate transfer body according to the present invention will now be described.

<Intermediate Transfer Body>

The intermediate transfer body includes a surface layer, an elastic layer, and a heat-insulating layer. The intermediate transfer body may be supported by a support member, as needed, and be used to form an image in a transfer system.

The size and the shape of the intermediate transfer body can be freely selected depending on the shape and the size of an intended print image. The whole shape of the intermediate transfer body is exemplified by a sheet shape, a roller shape, a drum shape, a belt shape, and an endless web shape.

(Surface Layer)

At least a part of an open surface of the surface layer of the intermediate transfer body (i.e., the back face opposite to the face adjoining the elastic layer) is used as the image forming surface. As the material constituting the surface layer, various materials including resins and ceramics can be appropriately used. These materials can be used singly or in combination of two or more of them.

The resin is specifically exemplified by acrylic resins, acrylic silicone resins, and fluorine-containing resins. The ceramic is exemplified by compounds prepared by hydrolysis and polycondensation of metal alkoxides, typically including inorganic compounds prepared by a sol-gel method. The metal alkoxide is exemplified by compounds represented by general formula: M(OR)n (M is a metal such as silicon, titanium, zirconium, and aluminum; and R is an alkyl group).

Specifically preferred are condensation products of hydrolyzable organic silicon compounds in terms of image quality and transferability. More preferred are condensation products of hydrolyzable organic silicon compounds having a polymerization structure by cationic polymerization, radical polymerization, or the like, in terms of durability.

When a surface layer has the molecular structure containing a siloxane bond derived from a hydrolyzable organic silicon compound, the component applied by an ink constituting an intermediate image effectively spreads on the image forming surface of the surface layer. In addition, such an intermediate transfer body easily releases an intermediate image, and the transferability is assumed to improve.

Specific examples of the hydrolyzable organic silicon compound include, but are not limited to, glycidoxypropyltrimethoxysilane, glycidoxypropyltriethoxysilane, glycidoxypropylmethyldimethoxysilane, glycidoxypropylmethyldiethoxysilane, glycidoxypropyldimethylmethoxysilane, glycidoxypropyldimethylethoxysilane, 2-(epoxycyclohexyl)ethyltrimethoxysilane, 2-(epoxycyclohexyl)ethyltriethoxysilane, compounds prepared by replacing the epoxy group of such a compound with an oxetanyl group, acryloxypropyltrimethoxysilane, acryloxypropyltriethoxysilane, acryloxypropylmethyldimethoxysilane, acryloxypropylmethyldiethoxysilane, acryloxypropyldimethylmethoxysilane, acryloxypropyldimethylethoxysilane, methacryloxypropyltrimethoxysilane, methacryloxypropyltriethoxysilane, methacryloxypropylmethyldimethoxysilane, methacryloxypropylmethyldiethoxysilane, methacryloxypropyldimethylmethoxysilane, methacryloxypropyldimethylethoxysilane, methyltrimethoxysilane, methyltriethoxysilane, dimethyldimethoxysilane, dimethyldiethoxysilane, trimethylmethoxysilane, trimethylethoxysilane, propyltrimethoxysilane, propyltriethoxysilane, hexyltrimethoxysilane, hexyltriethoxysilane, decyltrimethoxysilane, and decyltriethoxysilane.

The surface layer preferably contains such resins or ceramics in a total amount of 10% by mass or more to 100% by mass or less relative to the total mass of the surface layer. The surface layer more preferably contains such components in a total amount of 30% by mass or more and even more preferably 50% by mass or more. The surface layer can contain various fillers or additives within the above range.

The surface layer is specified to have a compressive elastic modulus E1 of 100 MPa or more to 1,000 MPa or less. When the compressive elastic modulus is 100 MPa or more, the abrasion resistance of an intermediate transfer body can be improved. When the compressive elastic modulus is 1,000 MPa or less, an excessively high resilience of an intermediate transfer body can be suppressed as a whole.

The surface layer preferably has a thickness of 0.01 μm or more to 10.0 μm or less from the viewpoint of mechanical strength or of suppressing the internal stress at the time of deformation to more effectively exert the function as the surface layer. As for the lower limit of the thickness of the surface layer, the surface layer preferably has a thickness of 0.1 μm or more. The upper limit of the thickness of the surface layer is more preferably 5.0 μm or less, and even more preferably 2.0 μm or less.

(Elastic Layer)

When an elastic layer is provided at the lower side of the surface layer in such a way as to be in direct contact with the surface layer through the interface of the surface layer, the following performance of the surface layer to a recording medium can be improved. As the material constituting the elastic layer, various materials including resins, elastomers, rubbers, and ceramics can be appropriately used. These materials can be used singly or in combination of two or more of them.

The material is preferably various elastomers and various rubbers in terms of processing characteristics, for example. Specific examples of the rubber include silicone rubber, fluororubber, chloroprene rubber, urethane rubber, nitrile rubber, ethylene-propylene rubber, natural rubber, styrene rubber, isoprene rubber, butadiene rubber, ethylene-propylene-diene rubber, and nitrile-butadiene rubber (acrylonitrile-butadiene rubber). These materials can be used singly or in combination of two or more of them. Particularly preferred are silicone rubber, fluororubber, and ethylene-propylene-diene rubber in terms of a small change in elastic modulus by temperature and of transferability. Thus, the elastic layer preferably contains at least one of an acrylonitrile-butadiene rubber, a silicone rubber, a fluororubber, and an ethylene-propylene-diene rubber, and more preferably contains at least one of a silicone rubber, a fluororubber, and an ethylene-propylene-diene rubber.

The elastic layer preferably contains such resins, ceramics, or rubbers in a total amount of 10% by mass or more to 100% by mass or less relative to the total mass of the elastic layer. The elastic layer more preferably contains such components in a total amount of 30% by mass or more and even more preferably 50% by mass or more. The elastic layer can contain various fillers or additives within the above range.

The elastic layer is specified to have a compressive elastic modulus E2 of 0.5 MPa or more to 50 MPa or less. The compressive elastic modulus E2 of the elastic layer is more preferably 3.0 MPa or more to 25.0 MPa or less and particularly preferably 5.0 MPa or more to 25.0 MPa or less. When the compressive elastic modulus is 0.5 MPa or more, the elastic layer is prevented from greatly deforming, and the surface layer is easily allowed to follow the deformation of the elastic layer. When the compressive elastic modulus is 50.0 MPa or less, the elastic layer can sufficiently relax a stress locally applied to the surface layer especially at a high speed, and the crack resistance and the transferability can also be improved.

The elastic layer preferably has a thickness of 0.05 mm or more to 0.5 mm or less in order to more effectively exert the above functions of the elastic layer. The upper limit of the thickness of the elastic layer is more preferably 0.2 mm or less.

(Heat-Insulating Layer)

When a heat-insulating layer is provided at the lower side of the elastic layer in such a way as to be in direct contact with the elastic layer through the interface of the elastic layer, the temperature controllability of the intermediate transfer body can be improved. When an intermediate transfer body is supported by a support member, the intermediate transfer body is supported while a heat-insulating layer is in direct contact with the support member. Alternatively, an intermediate transfer body further includes an additional layer between the heat-insulating layer and the support member, and the intermediate transfer body is supported through the additional layer. The material constituting the heat-insulating layer is exemplified by acrylonitrile-butadiene rubber, acrylic rubber, chloroprene rubber, urethane rubber, silicone rubber, fluororubber, and ethylene-propylene-diene rubber. These materials can be used singly or in combination of two or more of them. The heat-insulating layer preferably contains at least one of an acrylonitrile-butadiene rubber, a silicone rubber, a fluororubber, and an ethylene-propylene-diene rubber, and more preferably contains at least one of a silicone rubber, a fluororubber, and an ethylene-propylene-diene rubber.

When a heat-insulating layer is formed from a rubber material, the heat-insulating layer is preferably formed from a porous rubber material. A heat-insulating layer formed from a porous rubber material can be prepared by the following method: an unvulcanized rubber material is mixed with a vulcanizing agent, a vulcanization accelerator, an antifoaming agent, a filler for forming a porous body, and the like to form a layer; and when the layer is vulcanized into a rubber layer, the layer is subjected to a method of making a rubber layer porous. The material for forming a porous body is exemplified by hollow particles that can be added to a rubber layer to produce a porous rubber layer and sodium chloride that can be eluted from a rubber layer to produce a porous rubber layer.

When a heat-insulating layer is formed as a compressible layer having compressive elasticity, the deformation of the surface of an intermediate transfer body can be absorbed also by the heat-insulating layer, thus local pressure fluctuations can be dispersed, and good transferability can be maintained even at high speed printing. In particular, when a heat-insulating layer is formed from a porous rubber material, bubbles are compressed with volume changes in response to various pressure fluctuations to reduce deformation except in a compression direction, and more stable transferability and durability can be achieved. The porous rubber material includes a material having a continuous pore structure in which pores are connected to each other and a material having a closed pore structure in which pores are independent of each other. In the present invention, either of the structures may be used, or the structures may be used in combination.

The heat-insulating layer preferably contains such rubbers in a total amount of 10% by mass or more to 100% by mass or less relative to the total mass of the heat-insulating layer. The heat-insulating layer more preferably contains such components in a total amount of 30% by mass or more and even more preferably 50% by mass or more. The heat-insulating layer can contain various fillers or additives within the range.

The heat-insulating layer is preferably specified to have a compressive elastic modulus E3 of 0.5 MPa or more to 10 MPa or less in order to more effectively exert the functions as the compressible layer. For example, a heat-insulating layer having a compressive elastic modulus E3 of 0.5 MPa or more can improve the restorability of an intermediate transfer body or the application efficiency of a pressure required for transfer. A heat-insulating layer having a compressive elastic modulus E3 of 10 MPa or less can effectively prevent damage to an intermediate transfer body when a foreign substance is interposed between the intermediate transfer body and a recording medium at the time of transfer or when multiple recording media are fed, for example.

The heat-insulating layer preferably has a thickness of 0.1 mm or more to 1.5 mm or less in order to suppress distortion at the time of transfer and to effectively exert the compressive function when the heat-insulating layer is used as a compressible layer. As for the lower limit of the thickness of the heat-insulating layer, the heat-insulating layer more preferably has a thickness of 0.2 mm or more and even more preferably 0.5 mm or more. The upper limit of the thickness of the heat-insulating layer is more preferably 1.00 mm or less.

(Support Member)

The support member is used in order to impart conveyance properties or mechanical durability to an intermediate transfer body, as needed. The support member is thus required to have a certain structural strength from the viewpoint of the conveyance accuracy and the durability thereof.

As the material constituting the support member, a metal, a ceramic, or a resin is preferably used, for example. Specifically, aluminum, iron, stainless steel, acetal resins, epoxy resins, polyimide, polyethylene, polyethylene terephthalate, nylon, polyurethane, silica ceramics, and alumina ceramics are preferably used in terms of the rigidity capable of withstanding the pressure at the time of transfer, dimensional accuracy, and reduction of the inertia during operation to improve the control responsivity. It is also preferred to use these materials in combination. In accordance with the shape of a recording apparatus to be applied, the mode of transfer to a recording medium, the shape of an intermediate transfer body, or other conditions, a roller-shaped, drum-shaped, or belt-shaped support member can be used, for example. When an intermediate transfer body supported by a drum-shaped support member or a belt-shaped endless web-type support member is used, the same intermediate transfer body can be continuously, repeatedly used, and such a structure is preferred in terms of productivity.

(Relation of Physical Properties of Each Layer Constituting Intermediate Transfer Body)

Each layer constituting the intermediate transfer body according to the present invention satisfies the above relation, Equations 1 to 4, in the image forming method on a transfer system in which temperature control is performed to give $\Delta t$ (=t2−t1) (where 0° C.<$\Delta t$).

The intermediate image forming temperature t1 and the transferring temperature t2 can be adjusted by controlling the temperature of the surface layer of the intermediate transfer body (i.e., the surface temperature of the intermediate transfer body) as described above, for example. The temperature control of the surface layer of the intermediate transfer body is greatly affected by the heat quantity applied by the temperature controlling unit, the heat capacity of the surface layer, and the heat capacity of the elastic layer. For the intermediate transfer body according to the present invention, the surface layer and the elastic layer are thus provided so as to satisfy Equation 1: $(C1+C2)\times\Delta t\leq Q$, where C1 is the heat capacity per 1 $m^2$ of the surface layer, C2 is the heat capacity per 1 $m^2$ of the elastic layer, and Q is the heat quantity applied to 1 $m^2$ by the temperature controlling unit. When these layers satisfy the requirement, Equation 1, the temperature controllability of the surface layer of the intermediate transfer body can be improved. C1 and C2 can be set by selection of the materials forming these layers and by adjustment of the layer thicknesses.

In the present invention, the temperature control is performed to give a Q of 50,000 J or less (Q≤50,000 J). When the heat quantity Q is more than 50,000 J, the power consumption increases to lead to high cost, resulting in poor practicality. When Q is more than 50,000 J, the temperature of a whole apparatus also markedly increases.

The intermediate image forming temperature t1 is preferably 70° C. or less (t1≤70° C.) in order to prevent the temperature in an apparatus from excessively increasing. When an ink jet apparatus is used to form an intermediate image, this condition can effectively suppress clogging due to a temperature increase in an ink jet recording head. In order to increase the intermediate image formation speed, t1 is preferably 30° C. or more (30° C.≤t1) and more preferably 40° C. or more.

The transferring temperature t2 is preferably 100° C. or more (t2≥100° C.) from the viewpoint of achieving higher transferability. From the viewpoint of the heat resistance of constituent materials of the intermediate transfer body, t2 is preferably 250° C. or less (t2≤250° C.) and more preferably 200° C. or less.

In order to effectively satisfy both the transferability of an intermediate image to a recording medium and the retention of the image quality, $\Delta t$ is preferably 50° C. or more (50° C.≤$\Delta t$).

The intermediate transfer body according to the present invention includes the surface layer, the elastic layer, and the heat-insulating layer contiguously in the mentioned order, and thus (C1+C2) is equal to the heat capacity of the layers arranged closer to the image forming surface than the heat-insulating layer.

In the intermediate transfer body disclosed in Japanese Patent Application Laid-Open No. S62-124993, a reinforcement layer made from, for example, a woven fabric or a resin film is provided between an elastic layer and a compressible layer. In the structure according to the prior art, the heat capacity of the layers arranged closer to an image forming surface than a heat-insulating layer become large by the heat capacity of the reinforcement layer. The structure according to the prior art is thus difficult to satisfy Equation 2. An intermediate transfer body functions to transfer a formed intermediate image to a recording medium, thus the surface thereof is required to follow the recording medium surface, and the elastic layer is an essential component. To satisfy Equation 2, the reinforcement layer is required to have a minimum thickness, or the reinforcement layer is required to be removed. However, the study by the inventors of the present invention has revealed that when the reinforcement layer has a minimum thickness or the reinforcement layer is removed, an elastic layer having E2 satisfying Equation 3 largely deforms, resulting in deterioration of image quality. In other words, just by changing the thickness of the intermediate transfer body in the prior art, it is difficult to satisfy both the transferability of an image transferred from an intermediate transfer body to a recording medium and the retention of image quality. The intermediate transfer body according to the present invention is characterized in that the surface layer and the elastic layer satisfy Equations 2 and 3, respectively, and the surface layer and the elastic layer satisfy Equation 1 in order to prevent the deterioration of image quality.

In the present invention, the thermal conductivity $\lambda 1$ of the surface layer, the thermal conductivity $\lambda 2$ of the elastic layer, and the thermal conductivity $\lambda 3$ of the heat-insulating layer are set so as to satisfy Equation 4: $\lambda 3 \leq 0.13$ W/m·K$\leq \lambda 1 \leq \lambda 2$. When $\lambda 3$ is 0.13 W/m·K or less, t2 can be more efficiently increased. When $\lambda 3$ is more than 0.13 W/m·K, t2 is insufficiently increased, and the temperature controlling unit is required to apply a higher heat quantity Q.

When 0.13 W/m·K$\leq \lambda 1 \leq \lambda 2$ is satisfied, t2 can be more efficiently increased. When both $\lambda 1$ and $\lambda 2$ are less than 0.13 W/m·K, t2 is insufficiently increased, and the temperature controlling unit is required to apply a higher heat quantity Q.

When $\lambda 1 \leq \lambda 2$ is satisfied, the surface layer can have a uniform surface temperature, thus a local temperature drop can be suppressed, and the stability of transferability and retention of image quality can be improved. As for the relation of $\lambda 1$ and $\lambda 2$, $\lambda 1 \times 2 \leq \lambda 2$ is preferably satisfied in order to further improve such stability.

The image forming method and the image forming apparatus according to the present invention will next be described.

The image forming method according to the present invention includes a step of forming an intermediate image on an image forming surface of an intermediate transfer body at an intermediate image forming temperature t1 and a step of transferring the intermediate image to a recording medium at a transferring temperature t2. The image forming apparatus according to the present invention at least includes the following components.

(a) An intermediate transfer body (b) An image forming unit configured to form an intermediate image on an image forming surface of the intermediate transfer body (c) A temperature controlling unit configured to perform temperature control from the temperature t1 to a temperature t2

(d) A transfer unit configured to transfer an intermediate image from the intermediate transfer body to a recording body (e) A temperature controlling unit configured to perform temperature control to give $\Delta t$ (=t2−t1) (where 0° C.<$\Delta t$) that is the difference between an intermediate image forming temperature t1 in the image forming unit and a transferring temperature t2 in the transfer unit.

The image forming unit for forming an intermediate image includes an ink applying unit that applies an ink for forming an image to the intermediate transfer body. The image forming unit can further includes a liquid applying unit (also called reaction liquid applying unit) that applies a reaction liquid containing a component for increasing the viscosity of an ink, to the intermediate transfer body. By using at least a reaction liquid from the liquid applying unit and an ink from the ink applying unit to form an intermediate image, the viscosity of an ink to form an intermediate image can be increased. As the ink applying unit, an ink jet recording apparatus can be used.

From the viewpoint of high speed transfer, the step of transferring an intermediate image to a recording medium is preferably performed by using a transfer unit having a roller at least facing the intermediate transfer body (hereinafter also called transfer roller). When the support member supporting the intermediate transfer body has a roller shape, the rotation of the transfer roller is synchronized to the rotation of the roller-shaped support member, and a recording medium is inserted into and passed through a nip formed between the transfer roller and the intermediate transfer body in such a manner that the recording medium overlaps with the intermediate image held on the intermediate transfer body. The intermediate image is pressed at the nip while interposed between the intermediate transfer body and the recording medium. At the nip, the recording medium is pressed against the intermediate image, and the intermediate image adheres to the recording medium. After the passing through the nip, the intermediate transfer body and the recording medium are moved in a separation direction, then the intermediate image is released from the intermediate transfer body, and the intermediate image is transferred to the recording medium.

An embodiment of the image forming apparatus according to the present invention and an embodiment of the image forming method will next be described.

<Reaction Liquid>

The reaction liquid is also called a treatment liquid used for treating an image formed by an ink, and contains an ink-viscosity-increasing component. Here, "increase in viscosity of an ink" is the phenomenon including at least one of the cases (i) and (ii).

(i) A coloring material, a resin, or the like as a component constituting an ink comes into contact with an ink-viscosity-increasing component, and then is chemically reacted with or physically adsorbed to the component, causing an increase in viscosity of the whole ink.

(ii) A coloring material or the like as a component constituting an ink is aggregated to locally cause an increase in viscosity.

The ink-viscosity-increasing component has the effect of lowering the flowability of at least some of the ink applied onto an intermediate transfer body, thereby suppressing bleeding or beading at the time of image formation.

The concentration of the ink-viscosity-increasing component in the reaction liquid may be adjusted in accordance with the type of the ink-viscosity-increasing component, application conditions to an intermediate transfer body, and the type of an ink, for example.

As the ink-viscosity-increasing component, conventionally-known materials such as polyvalent metal ions, organic acids, cation polymers, and porous microparticles can be used. Specifically preferred are polyvalent metal ions and organic acids. A plurality of types of ink-viscosity-increasing components can also be preferably contained. The content of the ink-viscosity-increasing component in the reaction liquid is preferably 5% by mass or more relative to the total mass of the reaction liquid.

Examples of the metal ion specifically usable as the ink-viscosity-increasing component include divalent metal ions such as $Ca^{2+}$, $Cu^{2+}$, $Ni^{2+}$, $Mg^{2+}$, $Sr^{2+}$, $Ba^{2+}$, and $Zn^{2+}$ and trivalent metal ions such as $Fe^{3+}$, $Cr^{3+}$, $Y^{3+}$, and $Al^{3+}$.

Examples of the organic acid specifically usable as the ink-viscosity-increasing component include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumaric acid, thiophene carboxylic acid, nicotinic acid, oxysuccinic acid, and dioxysuccinic acid.

The reaction liquid can contain a single viscosity-increasing component or two or more viscosity-increasing components in combination.

The reaction liquid may contain an appropriate amount of water or an organic solvent. The water used in this case is preferably a deionized water prepared by ion exchanging, for example. The organic solvent usable in the reaction liquid is not limited to particular solvents, and any known organic solvent can be used.

To the reaction liquid, various resins can be added. For example, the addition of an appropriate resin to a reaction liquid enables an improvement in the adhesion of an intermediate image to a recording medium at the time of transfer or an increase in the mechanical strength of a final image, and thus is preferred. The material to be used for the resin may be any material that can coexist with the ink-viscosity increasing component. As the resin contained in the reaction liquid, resin used for ink as described below can be used.

To the reaction liquid, a surfactant or a viscosity modifier can be added to appropriately adjust the surface tension or the viscosity thereof, and such a reaction liquid can be used. The material to be used here may be any material that can coexist with the ink-viscosity increasing component. The surfactant specifically used is exemplified by Acetylenol E100 (trade name; manufactured by Kawaken Fine Chemicals). The reaction liquid is preferably adjusted to have a surface energy of 50 mN/m or less and more preferably 20 mN/m to 40 mN/m.

The reaction liquid usable in the present invention preferably contains a fluorochemical surfactant. Here, the fluorochemical surfactant is a compound having at least a hydrophobic fluorocarbon chain and a hydrophilic molecular chain (hydrophilic moiety) in the molecular structure thereof. When having a hydrophobic fluorocarbon chain, the fluorochemical surfactant exhibits excellent surface tension reducing properties as mentioned above.

In particular, a nonionic surfactant having a fluoroalkyl chain as the hydrophobic moiety and an ethylene oxide chain as the hydrophilic moiety is specifically preferably used. When having a fluoroalkyl chain as the hydrophobic moiety and an ethylene oxide chain as the hydrophilic moiety, the nonionic surfactant has high compatibility with a solvent or a reactant and thus exhibits excellent solubility even in a composition having a lower liquid content due to drying or the like. Hence, the uniformity of a reaction liquid layer and the surface tension reducing properties can be maintained.

In addition, when a nonionic surfactant is used, the structure thereof is not changed even after the reaction with an ink composition, and the characteristics thereof can be maintained. Hence, the uniformity of a reaction liquid layer and the surface tension reducing properties can be maintained.

The surfactant suitably used herein is exemplified by FSO100, FSN100, and FS3100 (trade names; manufactured by Du Pont) and F444, F477, and F553 (trade names; manufactured by DIC). The reaction liquid is preferably adjusted to have a surface energy of 20 mN/m or less.

The fluorochemical surfactant is preferably contained in an amount of 1% by mass or more to 10% by mass or less relative to the total mass of the reaction liquid. When the fluorochemical surfactant is contained in a small amount, the surface tension reducing properties is reduced, and thus the average ratio R of the surface area per unit area of the surface of an intermediate transfer body is preferably increased. For example, when the fluorochemical surfactant is contained in an amount of 5% by weight, R is preferably 1.5 or more. When the fluorochemical surfactant is contained in an amount of 1% by weight, R is preferably 1.7 or more.

<Application of Reaction Liquid>

As the method of applying a reaction liquid to the surface of an intermediate transfer body, various known techniques can be appropriately used. Specific examples of the technique include die coating, blade coating, techniques using gravure rollers, techniques using offset rollers, and spray coating. The method of using an ink jet device for application is also preferred. A combination of a plurality of methods is also particularly preferred.

<Ink>

Components usable in the ink will next be described.

(1) Coloring Material

The ink can contain at least one of pigments and dyes as the coloring material. The dye and the pigment are not limited to particular materials, can be selected from the materials usable as the coloring material for inks, and can be used in a required amount.

From the viewpoint of the durability, image quality, or the like of a printed matter, the coloring material is preferably a pigment, and at least a pigment is preferably used as the coloring material.

The content of the coloring material in the ink is preferably 0.5% by mass or more to 15.0% by mass or less and more preferably 1.0% by mass or more to 10.0% by mass or less relative to the total mass of the ink.

The dispersion method of a pigment in an ink is exemplified by the following methods.

(I) A method of using a resin-dispersion type pigment using a resin as a dispersant (a resin-dispersed pigment using a resin dispersant, a microcapsule pigment prepared by covering the surface of pigment particles with a resin, and a resin-bonded pigment prepared by chemically bonding an organic group containing a resin to the surface of pigment particles).

(II) A method of using a self-dispersible type pigment prepared by introducing hydrophilic groups onto the surface of pigment particles (self-dispersible pigments).

(2) Pigment

The pigment is not limited to particular pigments, and known inorganic pigments and organic pigments can be used. Specifically, pigments indicated by color index (C.I.) numbers can be used. As the black pigment, carbon black is also preferably used. The content of the pigment in the ink is preferably 0.5% by mass or more to 15.0% by mass or less and more preferably 1.0% by mass or more to 10.0% by mass or less relative to the total mass of the ink.

(3) Pigment Dispersant

As the dispersant for dispersing a pigment, any dispersant that has been used in known ink jetting can be used. Specifically, a water-soluble dispersant having both a hydrophilic moiety and a hydrophobic moiety in the molecular structure thereof is preferably used. In particular, a pigment dispersant composed of a resin prepared by copolymerizing a mixture containing at least a hydrophilic monomer and a hydrophobic monomer is preferably used. Each monomer used here is not limited to particular monomers, and known monomers are suitably used. Specifically, examples of the hydrophobic monomer include styrene, styrene derivatives, alkyl (meth)acrylates, and benzyl (meth)acrylate. Examples of the hydrophilic monomer include acrylic acid, methacrylic acid, and maleic acid. The dispersant preferably has an acid value of 50 mg KOH/g or more to 550 mg KOH/g or less. The dispersant preferably has a weight average molecular weight of 1,000 or more to 50,000 or less. The mass ratio of the pigment and the dispersant in the ink is preferably in a range of 1:0.1 to 1:3.

As another embodiment of the ink, what is called a self-dispersible pigment that is dispersible due to surface modification of a pigment itself and eliminates the use of the dispersant is also preferably used.

(4) Resin Microparticles

The ink can contain various microparticles having no coloring material. Of them, resin microparticles may have the effect of improving image quality or fixability and thus are preferred. The material of the resin microparticles is not limited to particular materials, and known resins can be appropriately used. The material is specifically exemplified by homopolymers such as polyolefin, polystyrene, polyurethane, polyester, polyether, polyurea, polyamide, polyvinyl alcohol, poly(meth)acrylic acid and salts thereof, polyalkyl (meth)acrylates, and polydienes; and copolymers prepared by copolymerizing a plurality of monomers of them in combination. The resin preferably has a mass average molecular weight of 1,000 or more to 2,000,000 or less. The content of the resin microparticles in the ink is preferably 1% by mass or more to 50% by mass or less and more preferably 2% by mass or more to 40% by mass or less relative to the total mass of the ink.

The resin microparticles are preferably used as a resin microparticle dispersion in which the resin microparticles are dispersed in an ink. The dispersion technique is not limited to particular techniques. Preferred is what is called a self-dispersion type resin microparticle dispersion in which a resin prepared by homopolymerization of a monomer having a dissociable group or by copolymerization of a plurality of such monomers is dispersed. The dissociable group is exemplified by a carboxyl group, a sulfonic acid group, and a phosphoric acid group, and the monomer having such a dissociable group is exemplified by acrylic acid and methacrylic acid. In addition, what is called an emulsion-dispersion type resin microparticle dispersion in which resin microparticles are dispersed with an emulsifier can be similarly, preferably used. As the emulsifier used herein, any known surfactant having a low molecular weight or a high molecular weight is preferably used. The surfactant is preferably a nonionic surfactant or a surfactant having the same charge as that of resin microparticles. The resin microparticle dispersion preferably has a dispersion particle diameter of 10 nm or more to 1,000 nm or less and more preferably 100 nm or more to 500 nm or less.

When a resin microparticle dispersion is prepared, various additives are also preferably added for stabilization. Examples of the additive include n-hexadecane, dodecyl methacrylate, stearyl methacrylate, chlorobenzene, dodecyl mercaptan, olive oil, a blue dye (bluing agent: Blue 70), and polymethyl methacrylate.

(5) Surfactant

The ink may contain a surfactant. The surfactant is specifically exemplified by Acetylenol EH (trade name; manufactured by Kawaken Fine Chemicals). In the ink, the content of the surfactant is preferably 0.01% by mass or more to 5.0% by mass or less relative to the total mass of the ink.

(6) Water and Water-Soluble Organic Solvent

As the liquid medium for the ink, an aqueous liquid medium including water and a mixture of water and a water-soluble organic solvent can be used. By adding a coloring material to an aqueous liquid medium, an aqueous ink can be prepared.

The water is preferably a deionized water prepared by ion exchanging, for example. In the ink, the content of the water is preferably 30% by mass or more to 97% by mass or less relative to the total mass of the ink. The water-soluble organic solvent to be used in the ink is not limited to particular types, and any known organic solvent can be used. The water-soluble organic solvent is specifically exemplified by glycerol, diethylene glycol, polyethylene glycol, and 2-pyrrolidone. In the ink, the content of the water-soluble organic solvent is preferably 3% by mass or more to 70% by mass or less relative to the total mass of the ink.

(7) Other Additives

The ink may contain various additives such as a pH adjuster, a rust inhibitor, an antiseptic, a fungicide, an antioxidant, an anti-reduction agent, a water-soluble resin and a neutralizer thereof, and a viscosity modifier, in addition to the above components as needed.

<Formation of Intermediate Image>

An ink can be applied to the image forming surface of an intermediate transfer body to form an intermediate image. As needed, a reaction liquid is further applied to increase in viscosity of the ink that forms the intermediate image, thereby effectively fixing the intermediate image onto the intermediate transfer body. The reaction liquid can be applied at least one of before and after the application of the ink. The ink and the reaction liquid are applied to the intermediate transfer body in such a manner as to at least partly overlap with each other. In order to more effectively allow a reaction liquid to increase in viscosity of an ink, a reaction liquid is preferably applied to the image forming surface of an intermediate transfer body before the application of an ink.

In the present specification, the image from the formation on the surface of an intermediate transfer body by an ink or by an ink together with a reaction liquid used as needed until the final transfer to a recording medium is called "intermediate image", for convenience.

To apply an ink, an ink jet device that applies an ink by the ink jet method can be used, for example. In the present invention, the temperature increase in an image forming apparatus can be suppressed even when an ink jet device is used for forming an intermediate image, and thus the discharge performance of an ink jet head of the ink jet device is unlikely to be affected. The ink jet device can be exemplified by the following systems.

A system that causes film boiling of an ink by an electrothermal converter to form bubbles and discharges the ink.

A system that discharges an ink by an electromechanical converter.

A system that discharges an ink by using static electricity.

In addition to the above devices, any of various ink jet devices applicable to the ink jet liquid discharge technique can also be used. Of them, the device using an electrothermal converter can be preferably used, particularly from the viewpoint of high-density printing at high speed.

The whole shape of the ink jet device is not limited to particular shapes. For example, the following ink jet heads can be used.

What is called a shuttle type ink jet head that performs recording while the head is scanned in a direction orthogonal to the moving direction of an intermediate transfer body.

What is called a line-head type ink jet head in which ink discharge orifices are arranged in a linear manner substantially orthogonal to the moving direction of an intermediate transfer body (i.e., substantially parallel with the axis direction for a drum-shaped intermediate transfer body).

<Removal of Liquid Content>

A step of reducing a liquid content from the intermediate image formed on an intermediate transfer body is also preferably included. When an intermediate image has an excess liquid content, the excess liquid may extrude or overflow in the transfer step, causing image disturbance or defective transfer. As the removal technique of the liquid content from an intermediate image, any of various techniques commonly used can be suitably used. For example, any of a heating method, a method of blowing low-humidity air, a decompression method, a method of bringing an absorber into contact, and a combination method of them can be suitably used. Liquid can also be removed by air drying.

<Transfer of Intermediate Image>

After the formation of an intermediate image, the intermediate transfer body is pressed against a recording medium to transfer the intermediate image to the recording medium, thereby yielding a final image. In the present specification, the "recording media" not only mean paper used in common printing but also widely include fabrics, plastics, films, and other printing media and recording media.

The technique of pressing an intermediate transfer body against a recording medium is not limited to particular techniques, and a pressure roller is preferably used to apply pressure from both sides of an intermediate transfer body and a recording medium, enabling efficient transfer and formation of an image. Pressing in multiple steps may have an effect of suppressing defective transfer, and is also preferred.

<Cleaning>

As described above, the image formation is completed through the application of a reaction liquid, the formation of an intermediate image by application of an ink, the removal of a liquid component, and the transfer of the intermediate image in an embodiment of the image recording method of the present invention. The intermediate transfer body may be repeatedly, continuously used from the viewpoint of productivity. In such a case, the surface is preferably cleaned before the next formation of an image. As the technique of cleaning the intermediate transfer body, any of conventional methods can be used, and any of the following methods can be suitably used, for example.

A method of applying a shower of a cleaning liquid to the surface of an intermediate transfer body.

A method of bringing a wet Moulton roller (trade name; manufactured by TECHNO ROLL CO., LTD) into contact with the surface of an intermediate transfer body and wiping the surface.

A method of bringing the surface of an intermediate transfer body into contact with the surface of a cleaning liquid.

A method of scraping the surface of an intermediate transfer body by using a wiper blade.

A method of applying various energies to the surface of an intermediate transfer body.

These methods are also preferably performed in combination.

<Fixation>

In the image forming method according to the present invention, the recording medium on which an image has been recorded after transfer may be treated with a fixing member to improve the fixability of the image to the recording medium. The fixing member is not limited to particular members, and a known heat roller can be used, for example. Alternatively, the fixability can be improved by heating a recording medium without bringing a fixing member into contact with the recording medium. Needless to say, a heat roller can be used to simultaneously perform them.

<Image Forming Apparatus>

An embodiment of the image forming apparatus according to the present invention is shown in the FIGURE.

In the apparatus shown in the FIGURE, the intermediate transfer body 11 of the present invention is provided on a support member 12. The method of providing the intermediate transfer body 11 on the support member 12 is not limited to particular methods, and a method using various adhesives or two-sided adhesive tapes can be used, for example. Alternatively, by attaching an installing member made from a metal, a ceramic, a resin, or a similar material to an intermediate transfer body, the intermediate transfer body may be fixed and held on a support member by using the installing member.

In the apparatus shown in the FIGURE, each device arranged around the intermediate transfer body 11 is configured to work in such a way as to synchronize with the rotation of the support member 12 having the intermediate transfer body 11.

The image forming unit in the apparatus shown in the FIGURE includes a roller type applicator 14 as a reaction liquid applying unit for applying a reaction liquid to an image formation region on the outer peripheral surface of the intermediate transfer body 11 and includes ink jet devices 15 as an ink applying unit.

In the roller type applicator 14, a reaction liquid contained in a container for a reaction liquid is carried by the rotation of two rollers on the outer peripheral surface of each roller. Then, by the rotation of the roller being in contact with the outer peripheral surface of the intermediate transfer body 11, the reaction liquid is applied from the roller to the outer peripheral surface of the intermediate transfer body 11.

The reaction liquid is applied to the intermediate transfer body in such a way as to at least partly overlap with a region of the intermediate transfer body where an ink is applied.

At the downstream side of the roller type applicator 14 in the rotation direction of the intermediate transfer body 11, the ink jet devices 15 are arranged in such a way as to face the outer peripheral surface of the intermediate transfer body 11. The ink jet devices 15 constitute the ink applying unit of the ink jet recording apparatus. From the ink jet devices 15, inks containing coloring materials for forming an image are applied to the image forming surface of the outer peripheral surface of the intermediate transfer body 11.

As the ink jet devices 15, a device including an electrothermal converter and discharging an ink on demand is used. As such an ink jet device, a line-head type ink jet head arranged in a linear manner substantially parallel with the rotation axis 13 of the support member 12 supporting the intermediate transfer body 11 can be used. In this way, a reaction liquid and an ink are sequentially applied on the outer peripheral surface of the intermediate transfer body 11, thereby forming an intermediate image (a mirror-reversed image with respect to a finally formed image on a recording medium).

The apparatus shown in the FIGURE has a heater 16 as a temperature controlling unit. By means of the heater 16, the temperature of the intermediate transfer body can be increased to the transfer temperature by the time of transfer of the intermediate image as described below. As the heater 16, an external heater such as an infrared heater can be used. Further, as the temperature controlling unit, other than the heater 16, a heater 17 built in the support member 12 of the intermediate transfer body 11 or a blower (not shown) can be used.

In order to reduce the liquid content in an intermediate image on the intermediate transfer body 11, the apparatus shown in the FIGURE may have a liquid removal unit. The liquid removal unit is exemplified by a heater and a blower. Also, above temperature controlling unit may have a function as the liquid removal unit.

At the further downstream side in the rotation direction of the intermediate transfer body 11, a pressure roller 19 having an outer peripheral surface facing to the outer peripheral surface of the intermediate transfer body 11 is provided. The transfer unit in the apparatus shown in the FIGURE includes a pressure roller 19, and the pressure roller faces to the intermediate transfer body 11 supported by the support member 12. By pressing the pressure roller 19 against the intermediate transfer body 11, a nip is formed. The pressure roller functions as the transfer roller. An intermediate image on the intermediate transfer body 11 and a recording medium 18 are stacked and inserted into the nip between the intermediate transfer body 11 and the pressure roller 19. By the pressure from the pressure roller, the intermediate image can be brought into contact with the recording medium 18 to be transferred to the recording medium 18.

In the apparatus shown in the FIGURE, the intermediate image on the intermediate transfer body 11 and the recording medium 18 are interposed and pressed between the intermediate transfer body 11 and the pressure roller 19, thereby achieving efficient image transfer. In other words, in an actual transfer step, an intermediate image formed on the intermediate transfer body 11 comes into contact with a recording medium 18 that is conveyed to the nip. The intermediate image is then peeled off from the intermediate transfer body 11 and is transferred onto the recording medium 18.

The recording medium 18 may be any printing paper and can be exemplified by coated papers and matte papers. The recording medium 18 may be a sheet cut into a predetermined shape, a long sheet, or a rolled sheet. The surface of the intermediate transfer body 11 after transferring the intermediate image is cleaned by the cleaning unit 20 having a roller used for cleaning.

The present invention can provide an intermediate transfer body that maintains the image quality of an intermediate image and has good transferability and provide an image forming method and an image forming apparatus using the intermediate transfer body.

EXAMPLES

The present invention will next be described in further detail with reference to examples and comparative examples of the intermediate transfer body and the image recording method. The present invention is not intended to be limited to the following examples without departing from the scope of the invention. In the following description, "part" means "part by mass", and "%" means "% by mass".

Physical properties of each layer constituting an intermediate transfer body were determined by the following methods.

(1) Compressive Elastic Modulus

An independent sample of each layer was prepared and measured for compressive elastic modulus by use of a viscoelastic spectrometer (DMS6100 (trade name); manufactured by Hitachi High-Tech Science Corporation) according to JIS K 7181.

(2) Layer Thickness

The thickness of each layer constituting an intermediate transfer body can be determined by cross sectional observation of a sample prepared by cutting the intermediate transfer body into an appropriate size. Thicknesses at 10 positions randomly selected were determined with an electron microscope (SU70 (trade name); manufactured by Hitachi High-Technologies Corporation) and the average was calculated.

(3) Heat Capacity

An independent sample (10 mg) of each layer was prepared and measured for specific heat capacity (J/g·K) by means of a differential scanning calorimeter (DSC6100 (trade name); manufactured by Hitachi High-Tech Science Corporation) according to JIS K 7123. Further, by performing the calculation of (specific heat capacity of sample)×(volume of sample)×(density of sample), heat capacity per 1 $m^2$ was obtained.

(4) Heat Quantity

The heat quantity was calculated from the power consumption, the heating time, and the efficiency of the infrared heater as a temperature controlling unit of the image forming apparatus. Specifically, the heat quantity was determined by performing the calculation of (power consumption (W))×(heating time (second))×(efficiency (%)).

(5) Thermal Conductivity

An independent sample of each layer was prepared, and the thermal conductivity was determined by the same technique as in JIS R 1611.

Example 1

The image forming apparatus in the FIGURE was used to form an image on a recording medium. As the support member 12 of the intermediate transfer body 11, a cylindrical-shaped drum made from an aluminum alloy was used. This structure can satisfy required characteristics including the rigidity capable of withstanding the pressure at the time of transfer, dimensional accuracy, and a reduction of the rotation inertia to improve the control responsivity.

The intermediate transfer body, the reaction liquid, and the ink used in the apparatus in the FIGURE were prepared by the following procedures.

(Intermediate Transfer Body)

(Heat-Insulating Layer)

A material prepared by mixing an acrylonitrile-butadiene rubber with known various additives was made into a layer, and then the layer was vulcanized to give a porous compressible layer satisfying the physical properties shown in Table 1.

(Elastic Layer)

On the compressible layer, a silicone rubber was molded. Various physical properties such as elastic modulus of the elastic layer were adjusted as described in Table 1.

(Surface Layer)

Glycidoxypropyltriethoxysilane and methyltriethoxysilane were appropriately mixed, then the mixture was heated and refluxed in a water solvent with hydrochloric acid as a catalyst for 24 hours or more, giving a solution containing a condensation product produced by condensation of the organic silicon compounds. The solution was diluted with methyl isobutyl ketone to 12% by mass, and a photocationic polymerization initiator, SP150 (manufactured by ADEKA) was added at 5% by mass relative to the solid content, giving a coating liquid. The coating liquid was applied to the elastic layer that had been subjected to plasma treatment, forming a film. Next, an UV lamp was used to perform irradiation and exposure, and then the film was heated at 120° C. for 2 hours to be cured, thereby forming the surface layer to give an intermediate transfer body.

The thickness and physical properties of each layer of the prepared intermediate transfer body are shown in Table 1.

The physical properties of the surface layer were adjusted by changing the mixing ratio of glycidoxypropyltriethoxysilane and methyltriethoxysilane or by appropriately adding a thermal conductive filler such as alumina.

The physical properties of the elastic layer and the heat-insulating layer were also adjusted by a mixing ratio or an additive in a similar manner.

(Preparation of Reaction Liquid)

The reaction liquid was prepared as follows: components were mixed in accordance with the following formulation and thoroughly stirred; and then the mixture was subjected to pressure filtration through a microfilter with a pore size of 3.0 μm (manufactured by Fujifilm Corporation), giving the reaction liquid.

Glutaric acid 55 parts

8N Aqueous potassium hydroxide 20 parts

Glycerol 10 parts

Surfactant (Acetylenol E100) 1 part

Ion-exchanged water 14 parts (Preparation of Ink)

First, pigment dispersion liquids and a resin microparticle dispersion were prepared by the following procedures.

(1) Preparation of Black Pigment Dispersion Liquid

First, 10 parts of carbon black (trade name: Monarch 1100; manufactured by Cabot Corporation), 15 parts of an aqueous solution of a pigment dispersant (a styrene-ethyl acrylate-acrylic acid copolymer <an acid value of 150, a weight average molecular weight of 8,000>; a solid content of 20%; neutralized with potassium hydroxide), and 75 parts of pure water were mixed. The mixed liquid was placed in a batch type vertical sand mill (manufactured by Aimex), and then 200 parts of 0.3-mm zirconia beads were placed. The mixture was dispersed for 5 hours while cooled with water. The dispersion liquid was centrifuged by a centrifuge separator to remove coarse particles, giving a black pigment dispersion liquid having a pigment concentration of about 10%.

(2) Preparation of Cyan Pigment Dispersion Liquid

The same procedure as in the preparation of a black pigment dispersion liquid was performed except that 10 parts of carbon black used in the preparation of a black pigment dispersion liquid was replaced with 10 parts of C.I. Pigment Blue 15:3, giving a cyan pigment dispersion liquid.

(3) Preparation of Magenta Pigment Dispersion Liquid

The same procedure as in the preparation of a black pigment dispersion liquid was performed except that 10 parts of carbon black used in the preparation of a black pigment dispersion liquid was replaced with 10 parts of C.I. Pigment Red 122, giving a magenta pigment dispersion liquid.

(4) Preparation of Yellow Pigment Dispersion Liquid

The same procedure as in the preparation of a black pigment dispersion liquid was performed except that 10 parts of carbon black used in the preparation of a black pigment dispersion liquid was replaced with 10 parts of C.I. Pigment Yellow 74, giving a yellow pigment dispersion liquid.

(5) Preparation of Resin Microparticle Dispersion

First, 18 parts of butyl methacrylate, 2 parts of 2,2'-azobis-(2-methylbutyronitrile), and 2 parts of n-hexadecane were mixed, and the mixture was stirred for 0.5 hour. The mixture was added dropwise to 78 parts of 6% aqueous solution of a styrene-acrylic acid copolymer (an acid value of 120 mg KOH/g, a weight average molecular weight of 8,700) as an emulsifier, and the whole was stirred for 0.5 hour. Next, the mixture was sonicated with a sonicator for 3 hours. Subsequently, the mixture was polymerized under a nitrogen atmosphere at 80° C. for 4 hours. The reaction mixture was cooled to room temperature and then filtered, giving a resin microparticle dispersion having a concentration of about 20%. The resin microparticles had a mass average molecular weight of about 200,000 and a dispersion particle diameter of about 250 nm.

In accordance with the following formulations, a black ink, a cyan ink, a magenta ink, and a yellow ink were prepared. Specifically, the following components were mixed and thoroughly stirred, and then the mixture was subjected to pressure filtration through a microfilter with a pore size of 3.0 μm (manufactured by Fujifilm Corporation).

A corresponding color pigment dispersion liquid (a concentration of about 10%) 20 parts The above resin microparticle dispersion (a concentration of about 20%) 20 parts Glycerol 5 parts Diethylene glycol 5 parts Surfactant (Acetylenol EH) 1 part Ion-exchanged water 45 parts (Image Forming Method)

As shown in the FIGURE, the intermediate transfer body prepared by the above procedure was provided on the outer peripheral surface of a support member 12. Next, to form an image, a reaction liquid is applied onto the surface of the intermediate transfer body with a roller type applicator 14 while the intermediate transfer body 11 is rotated in the arrow direction in the FIGURE. Then, inks are discharged from ink jet devices 15 onto the surface of the intermediate transfer body. On the surface of the intermediate transfer body 11, the reaction liquid and the inks are thus reacted to form an intermediate image. After the formation of the intermediate image, the temperature of the intermediate image was controlled by the heater 16 as a temperature controlling unit. As the heater 16, an infrared heater (short wavelength infrared heater; manufactured by Heraeus Holding) was used. Incidentally, the heater 16 also has a function of a liquid removing unit for removing water in the intermediate image. As the intermediate transfer body rotates, the intermediate image next passes through the space (nip) between the intermediate transfer body and a pressure roller 19. During the passing, the intermediate image is pressed against a recording medium 18, and the intermediate image is transferred from the intermediate transfer body to the recording medium 18. As the recording medium, matt coated paper (New V Matt (trade name); manufactured by MITSUBISHI PAPER MILLS LIMITED) was used. Further, the conveyance speed of the recording medium was set to be 0.5 m/s. The surface of the intermediate transfer body after the transfer of the intermediate image is cleaned with a cleaning unit 20. By repeating the above operation together with the rotation of the intermediate transfer body, image recording is repeatedly performed.

As the discharge pattern for an intermediate image, 1 cm×1 cm solid images at recording duties of 100% and 300% were used as a 100% solid color pattern and a 300% solid color pattern, respectively. With the above image recorder, the condition in which 4 ng of an ink drop is applied to a unit area of 1/1,200 inch×1/1,200 inch at a resolution of 1,200 dpi×1,200 dpi is defined as a recording duty of 100%.

The transferability and the image quality of prepared images were evaluated by the following procedures. The intermediate image forming temperature t1 for the formation of an intermediate image, the transferring temperature t2 for the transfer to a recording medium, and the heat quantity Q per 1 $m^2$ applied from a temperature controlling unit were as shown in Table 2. The intermediate image forming temperature t1 was the surface temperature of an intermediate transfer body at a position where an ink is applied onto the intermediate transfer body to form an intermediate image. The transferring temperature t2 was the surface temperature of an intermediate transfer body at a position just before the contact of the intermediate transfer body with the transfer roller. The surface temperature of an intermediate transfer body was determined with an infrared thermometer.

(Evaluation of Image Transferability)

The area where the image was formed on the intermediate transfer body after the transfer step was observed under an optical microscope to determine the residual area of an intermediate image, and [100−(residual area of intermediate image)/(area of intermediate image)] was calculated as the transfer ratio to a recording medium. Based on the transfer ratio to the recording medium, image transferability was evaluated on the basis of the following criteria.

<Evaluation Criteria of Transferability>

AA: The transfer ratio to a recording medium is 95% or more.

A: The transfer ratio to a recording medium is not less than 90% and less than 95%.

B: The transfer ratio to a recording medium is not less than 80% and less than 90%.

C: The transfer ratio to a recording medium is less than 80%.

(Evaluation of Image Quality)

For the evaluation of image quality, an intermediate image formed on an intermediate transfer body and a final image on a recording medium were observed under an optical microscope to determine the area of each image, and the rate of change [(final image area−intermediate image area)/(final image area)] was calculated to evaluate the image quality on the basis of the following criteria.

<Evaluation Criteria of Image Quality>

AA: The rate of change is less than 0.5%.

A: The rate of change is not less than 0.5% and less than 1.0%.

B: The rate of change is not less than 1.0% and less than 3.0%.

C: The rate of change is 3.0% or more.

The obtained evaluation results are shown in Table 3.

Examples 2 to 18 and Comparative Examples 1 to 3

The same procedure as in Example 1 was performed to form images except that intermediate transfer bodies having physical properties shown in Table 1 were used and the temperature control conditions were changed as shown in Table 2, and the transferability and the image quality of the prepared images were evaluated. The obtained evaluation results are shown in Table 3.

TABLE 1

| | Surface layer | | | | Elastic layer | | | | Heat-insulating layer | | |
|---|---|---|---|---|---|---|---|---|---|---|---|
| | Thickness μm | E1 MPa | C1 J/K | λ1 W/m · K | Thickness mm | E2 MPa | C2 J/K | λ2 W/m · K | Thickness mm | E3 MPa | λ3 W/m · K |
| Example 1 | 0.1 | 200 | 0.1 | 0.15 | 0.2 | 25 | 300 | 0.70 | 0.7 | 5 | 0.05 |
| Example 2 | 2.0 | 200 | 1.5 | 0.15 | 0.2 | 25 | 300 | 0.70 | 0.7 | 5 | 0.05 |
| Example 3 | 1.0 | 100 | 0.8 | 0.15 | 0.2 | 25 | 300 | 0.70 | 0.7 | 5 | 0.05 |
| Example 4 | 1.0 | 1000 | 0.8 | 0.15 | 0.2 | 25 | 300 | 0.70 | 0.7 | 5 | 0.05 |
| Example 5 | 1.0 | 200 | 0.8 | 0.15 | 0.2 | 25 | 300 | 0.50 | 0.7 | 5 | 0.05 |
| Example 6 | 1.0 | 200 | 0.8 | 0.15 | 0.2 | 25 | 300 | 1.00 | 0.7 | 5 | 0.05 |
| Example 7 | 1.0 | 200 | 1.0 | 0.15 | 0.1 | 25 | 150 | 0.70 | 0.7 | 5 | 0.05 |
| Example 8 | 1.0 | 200 | 1.0 | 0.15 | 0.5 | 25 | 750 | 0.70 | 0.7 | 5 | 0.05 |
| Example 9 | 1.0 | 200 | 1.0 | 0.15 | 0.2 | 0.5 | 300 | 0.70 | 0.7 | 5 | 0.05 |
| Example 10 | 1.0 | 200 | 1.0 | 0.15 | 0.2 | 50 | 300 | 0.70 | 0.7 | 5 | 0.05 |
| Example 11 | 1.0 | 200 | 1.0 | 0.13 | 0.2 | 25 | 300 | 0.70 | 0.7 | 5 | 0.05 |
| Example 12 | 1.0 | 200 | 1.0 | 0.30 | 0.2 | 25 | 300 | 0.70 | 0.7 | 5 | 0.05 |
| Example 13 | 1.0 | 200 | 1.0 | 0.15 | 0.2 | 25 | 300 | 0.70 | 0.5 | 5 | 0.05 |
| Example 14 | 1.0 | 200 | 1.0 | 0.15 | 0.2 | 25 | 300 | 0.70 | 1.5 | 5 | 0.05 |
| Example 15 | 1.0 | 200 | 1.0 | 0.15 | 0.2 | 25 | 300 | 0.70 | 0.7 | 1 | 0.05 |
| Example 16 | 1.0 | 200 | 1.0 | 0.15 | 0.2 | 25 | 300 | 0.70 | 0.7 | 10 | 0.05 |
| Example 17 | 1.0 | 200 | 1.0 | 0.15 | 0.2 | 25 | 300 | 0.70 | 0.7 | 5 | 0.02 |
| Example 18 | 1.0 | 200 | 1.0 | 0.15 | 0.2 | 25 | 300 | 0.70 | 0.7 | 5 | 0.08 |
| Comparative Example 1 | 1.0 | 10 | 1.0 | 0.15 | 0.2 | 25 | 300 | 0.70 | 0.7 | 5 | 0.05 |
| Comparative Example 2 | 1.0 | 200 | 1.0 | 0.15 | 1.0 | 25 | 1500 | 0.70 | 0.7 | 5 | 0.05 |
| Comparative Example 3 | 1.0 | 200 | 1.0 | 0.15 | 0.2 | 25 | 300 | 0.70 | 0.7 | 5 | 0.20 |

TABLE 2

| | Temperature | | | Heat quantity |
|---|---|---|---|---|
| | t1 ° C. | t2 ° C. | Δt K | Q J |
| Example 1 | 25 | 100 | 75 | 30000 |
| Example 2 | 25 | 120 | 95 | 30000 |
| Example 3 | 25 | 150 | 125 | 50000 |
| Example 4 | 25 | 180 | 155 | 50000 |
| Example 5 | 40 | 100 | 60 | 30000 |
| Example 6 | 40 | 120 | 80 | 30000 |
| Example 7 | 40 | 150 | 110 | 30000 |
| Example 8 | 60 | 120 | 60 | 50000 |
| Example 9 | 60 | 150 | 90 | 50000 |
| Example 10 | 70 | 120 | 50 | 30000 |
| Example 11 | 70 | 150 | 80 | 50000 |
| Example 12 | 60 | 140 | 80 | 50000 |
| Example 13 | 60 | 140 | 80 | 50000 |
| Example 14 | 60 | 140 | 80 | 50000 |
| Example 15 | 60 | 140 | 80 | 50000 |

TABLE 2-continued

| | Temperature | | | Heat quantity |
|---|---|---|---|---|
| | t1 ° C. | t2 ° C. | Δt K | Q J |
| Example 16 | 60 | 140 | 80 | 50000 |
| Example 17 | 60 | 140 | 80 | 50000 |
| Example 18 | 60 | 140 | 80 | 50000 |
| Comparative Example 1 | 60 | 140 | 80 | 50000 |
| Comparative Example 2 | 60 | 140 | 80 | 50000 |
| Comparative Example 3 | 60 | 80 | 20 | 50000 |

TABLE 3

| | Transferability | Image quality |
|---|---|---|
| Example 1 | AA | AA |
| Example 2 | AA | AA |
| Example 3 | AA | AA |
| Example 4 | A | A |
| Example 5 | AA | AA |
| Example 6 | AA | AA |
| Example 7 | AA | AA |
| Example 8 | AA | A |
| Example 9 | AA | A |
| Example 10 | A | A |
| Example 11 | A | A |
| Example 12 | A | A |
| Example 13 | AA | AA |
| Example 14 | AA | A |
| Example 15 | AA | AA |
| Example 16 | AA | A |
| Example 17 | AA | AA |
| Example 18 | A | A |
| Comparative Example 1 | AA | C |
| Comparative Example 2 | C | C |
| Comparative Example 3 | C | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-125681, filed Jun. 24, 2016, which is hereby incorporated by reference herein in its entirety.

What is claimed is:

1. An image forming method comprising:

a step of applying an ink to an image forming surface of an intermediate transfer body to form an intermediate image of a temperature t1;

a step of performing temperature control such that the temperature of the intermediate image changes from the temperate t1 to a temperature t2; and a step of transferring the intermediate image of the temperature t2 to a recording medium, wherein the intermediate transfer body includes a surface layer having the image forming surface, an elastic layer, and a heat-insulating layer contiguously in the mentioned order, and wherein the surface layer, the elastic layer, and the heat-insulating layer satisfy equations 1 to 4:

$$(C1+C2)\times\Delta t\leq Q, \quad \text{equation 1:}$$

where C1 is a heat capacity per 1 $m^2$ of the surface layer; C2 is a heat capacity per 1 $m^2$ of the elastic layer; Δt=t2−t1 and Δt>0° C. are satisfied; Q is a heat quantity applied to 1 $m^2$ of a surface of the surface layer by heating at the temperature t1; and Q≤50,000 J;

$$100\ \text{MPa}\leq E1\leq 1{,}000\ \text{MPa}, \quad \text{equation 2:}$$

where E1 is a compressive elastic modulus of the surface layer;

$$0.5\ \text{MPa}\leq E2\leq 50\ \text{MPa}, \quad \text{equation 3:}$$

where E2 is a compressive elastic modulus of the elastic layer; and $$\lambda 3\leq 0.13\ \text{W/m·K}\leq\lambda 1\leq\lambda 2, \quad \text{equation 4:}$$

where λ1 is a thermal conductivity of the surface layer; λ2 is a thermal conductivity of the elastic layer; and λ3 is a thermal conductivity of the heat-insulating layer.

2. The image forming method according to claim 1, wherein t1≤70° C., and 100° C.≤t2.

3. The image forming method according to claim 1, wherein the surface layer has a thickness of 0.1 μm to 10.0 μm.

4. The image forming method according to claim 1, wherein the elastic layer has a thickness of 0.05 mm to 0.5 mm.

5. The image forming method according to claim 1, wherein the heat-insulating layer has a compressive elastic modulus E3 of 0.5 MPa to 10 MPa.

6. The image forming method according to claim 1, wherein the heat-insulating layer has a thickness of 0.5 mm to 1.5 mm.

7. The image forming method according to claim 1, wherein the thermal conductivity λ1 of the surface layer and the thermal conductivity λ2 of the elastic layer satisfy λ1×2≤λ2.

8. The image forming method according to claim 1, wherein the surface layer contains a condensation product of an organic silicon compound.

9. The image forming method according to claim 1, wherein the elastic layer contains at least one of an acrylonitrile-butadiene rubber, a silicone rubber, a fluororubber, and an ethylene-propylene-diene rubber.

10. The image forming method according to claim 1, wherein the heat-insulating layer contains at least one of an acrylonitrile-butadiene rubber, a silicone rubber, a fluororubber, and an ethylene-propylene-diene rubber.

11. The image forming method according to claim 1, wherein the intermediate image is formed by an ink jet method.

12. The image forming method according to claim 1, wherein 30° C.<t1<70° C.

13. The image forming method according to claim 1, wherein 100° C.<t2<250° C.

14. The image forming method according to claim 1, wherein Δt ≥50° C.

15. An intermediate transfer body used for an image forming method, the image forming method including a step of applying an ink to an image forming surface of an intermediate transfer body to form an intermediate image of a temperature t1; a step of performing temperature control such that the temperature of the intermediate image changes from the temperate t1 to a temperature t2; and a step of transferring the intermediate image of the temperature t2 to a recording medium, wherein the intermediate transfer body satisfies equations 1 to 4:

$$(C1+C2)\times\Delta t\leq Q, \quad \text{equation 1:}$$

where C1 is a heat capacity per 1 $m^2$ of the surface layer; C2 is a heat capacity per 1 $m^2$ of the elastic layer; $\Delta t = t2 - t1$ and $\Delta t > 0°$ C. are satisfied; Q is a heat quantity applied to 1 $m^2$ of a surface of the surface layer by heating at the temperature t1; and $Q \leq 50{,}000$ J;

$$100\ \text{MPa} \leq E1 \leq 1{,}000\ \text{MPa}, \quad \text{equation 2:}$$

where E1 is a compressive elastic modulus of the surface layer $$0.5\ \text{MPa} \leq E2 \leq 50\ \text{MPa}, \quad \text{equation 3:}$$

where E2 is a compressive elastic modulus of the elastic layer; and $$\lambda 3 \leq 0.13\ \text{W/m·K} \leq \lambda 1 \leq \lambda 2, \quad \text{equation 4:}$$

where λ1 is a thermal conductivity of the surface layer; λ2 is a thermal conductivity of the elastic layer; and λ3 is a thermal conductivity of the heat-insulating layer.

16. An image forming apparatus comprising:

an intermediate transfer body;

an image forming unit configured to apply an ink to an image forming surface of the intermediate transfer body to form an intermediate image of a temperature t1, a temperature controlling unit configured to control the temperature of the intermediate image from the temperature t1 to a temperature t2, and a transfer unit configured to transfer the intermediate image of the temperature t2 from the intermediate transfer body to a recording medium, wherein the intermediate transfer body includes a surface layer having the image forming surface, an elastic layer, and a heat-insulating layer contiguously in the mentioned order, and wherein the surface layer, the elastic layer, and the heat-insulating layer satisfy equations 1 to 4:

$$(C1 + C2) \times \Delta t \leq Q, \quad \text{equation 1:}$$

where C1 is a heat capacity per 1 $m^2$ of the surface layer; C2 is a heat capacity per 1 $m^2$ of the elastic layer; $\Delta t = t2 - t1$ and $\Delta t > 0°$ C. are satisfied; Q is a heat quantity applied to 1 $m^2$ of a surface of the surface layer by heating at the temperature t1; and $Q \leq 50{,}000$ J;

$$100\ \text{MPa} \leq E1 \leq 1{,}000\ \text{MPa}, \quad \text{equation 2:}$$

where E1 is a compressive elastic modulus of the surface layer;

$$0.5\ \text{MPa} \leq E2 \leq 50\ \text{MPa}, \quad \text{equation 3:}$$

where E2 is a compressive elastic modulus of the elastic layer; and $$\lambda 3 \leq 0.13\ \text{W/m·K} \leq \lambda 1 \leq \lambda 2, \quad \text{equation 4:}$$

where λ1 is a thermal conductivity of the surface layer; λ2 is a thermal conductivity of the elastic layer; and λ3 is a thermal conductivity of the heat-insulating layer.

17. The image forming apparatus according to claim 16, wherein the image forming unit includes an ink jet recording apparatus configured to apply an ink for forming the intermediate image, to the intermediate transfer body.

18. The image forming apparatus according to claim 16, wherein t1<70° C., and 100° C.<t2.

19. The image forming apparatus according to claim 16, wherein 30° C.<t1<70° C.

20. The image forming apparatus according to claim 16, wherein 100° C.<t2<250° C.

21. The image forming apparatus according to claim 16, wherein Δt>50° C.

* * * * *